United States Patent [19]

Hansen

[11] 3,964,717

[45] June 22, 1976

[54] TUBE MILL

[75] Inventor: Ib Hansen, Copenhagen Valby, Denmark

[73] Assignee: F. L. Smidth & Co., Cresskill, N.J.

[22] Filed: Sept. 5, 1974

[21] Appl. No.: 503,306

[30] Foreign Application Priority Data

Sept. 10, 1973 United Kingdom ..... 42365/73

[52] U.S. Cl. ..... 241/71; 241/70; 241/153; 241/171

[51] Int. Cl.[2] ..... B02C 17/00; B02C 17/18

[58] Field of Search ..... 241/70, 72, 71, 80, 241/153, 171

[56] References Cited

UNITED STATES PATENTS

| | | | |
|---|---|---|---|
| 1,787,897 | 1/1931 | Durnin | 241/72 |
| 2,332,701 | 10/1943 | Dowsett | 241/80 X |
| 3,776,477 | 12/1973 | Hansen et al. | 241/153 X |

*Primary Examiner*—Roy Lake
*Assistant Examiner*—E. F. Desmond
*Attorney, Agent, or Firm*—Pennie & Edmonds

[57] ABSTRACT

A tube mill for dry grinding of a granular material, the mill being formed with one or more grinding compartments charged with grinding bodies and, downstream of the first or sole grinding compartment, a relatively short compartment bounded downstream by a dam ring having a central opening and upstream by a sieving diaphragm for holding back the grinding bodies, but permitting fluidized ground material to flow from the upstream grinding compartment to the short compartment and vice versa, the short compartment being adapted to serve as a reservoir of fluidized ground material.

18 Claims, 7 Drawing Figures

TUBE MILL

BACKGROUND OF THE INVENTION

1. Field of the Invention

This invention relates to tube mills of the type having grinding bodies for dry grinding granular materials and the like.

2. Description of the Prior Art

Present day grinding mills — particularly those which are used for dry grinding coarse materials such as cement clinker — incorporate a short compartment to improve the performance of the mill. The short compartment is generally installed in order to maintain a permanent pool of ground material in the upstream grinding compartment.

The short compartment is devoid of any lifters or other devices that would prevent the formation and maintenance in it of a pool of fluidized material of substantial depth. However, it may have a central part designed for discharging material into the downstream grinding compartment or out of the mill. The central part may have scoops the ends of which are at such distance from the peripheral wall of the mill as to allow the pool to remain at the desired level.

When present in the upstream grinding compartment, the pool of fluidized material reduced considerably the wear on the mill lining and the grinding bodies. Further, there is an increase in the efficiency as measured in the power consumption. In addition, the usual grinding noise is reduced and the grinding process can be carried on at a grinding noise level lower than was previously considered desirable when an optimum of the grinding efficiency should be achieved.

The size of the central opening through the dam ring — and to some extent the central scoop apparatus — constitute a factor which determines the actual depth of the fluidized pool in the first or sole grinding compartment. In certain circumstances this condition might be disadvantageous.

The size of the central opening is often fixed by the preferred depth of the charge in the downstream grinding compartment or the discharge outlet through a hollow trunnion and dependent upon the required volume of ventilating air to be passed through the mill. This presents an additional difficulty in designing the central opening of the dam ring to suit the conditions aimed at in the first or sole grinding compartment.

Further, in a multi-compartment mill in which the short compartment separates two grinding compartments the central opening of the dam ring may give rise to some difficulties in the performance of the mill because grinding bodies from the downstream grinding compartment may, in their tumbling action during the rotation of the mill, pass to the short compartment. In the known mills the grinding bodies cannot be returned to the grinding compartment because the short lifters forming the discharge apparatus are unable to pick up the grinding bodies.

In an attempt to prevent grinding bodies from passing back from the downstream grinding compartment the dam ring might be provided with a coarse screen or a shroud protruding into the downstream grinding compartment to serve as an obstacle to this undesirable passage of grinding bodies. However, in certain circumstances, for example, when using very small grinding bodies in the downstream grinding compartment, it might still be difficult to prevent the grinding bodies from passing into the short compartment and yet ensure the unhindered passage of the ground material and ventilating air through the mill.

I have invented a grinding mill in which these disadvantages are eliminated and in which efficient transporting of the ground material is obtained.

SUMMARY OF THE INVENTION

A tube mill for dry grinding a granular material and the like comprising at least one grinding compartment charged with grinding bodies, a relatively short compartment positioned downstream of said grinding compartment and bounded on the downstream portion by a dam ring defining a central opening and on the upstream portion by a sieving means capable of retaining the grinding bodies in the grinding compartment. The short compartment is so configured to permit fluidized ground material to flow at least from the upstream grinding compartment to the short compartment. Further the short compartment has an intermediate plate defining at least one opening remote from the peripheral wall of the mill and positioned to correspond to the intended level of fluidized material. The plate divides the short compartment into an upstream section devoid of any lifters and a downstream section having lifters. The lifters are so configured as to assist in transporting the material from the downstream section of the short compartment into a downstream grinding compartment or out of the mill.

Improvements are thus obtained, according to the invention, by installing in the short compartment the intermediate plate having one or a few openings remote from the peripheral wall of the mill and corresponding to the intended level of fluidized material. This divides the short compartment into an upstream section devoid of any lifters and a downstream section having lifters to permit a substantially complete emptying of the contents of the downstream section into a downstream grinding compartment or out of the mill.

The intermediate plate thus constitutes a dam device in the short compartment by means of which the short compartment is divided into a first section, adapted to serve as a reservoir of fluidized ground material in this section, and a second section, having a scoop apparatus or an elevator enabling discharge of material into the downstream grinding compartment. It also facilitates discharge of grinding bodies which may unintentionally pass into the short compartment from the downstream grinding compartment. Further, positioning the scoop apparatus at some distance from the screening diaphragm facilitates utilization of the full area of the diaphragm for passage of ground material and ventilating air without difficulty.

In the known construction of the present day, it is necessary to take measures to make certain that the short scoop apparatus is separated from the screening diaphragm. An example of such separation is by the provision of a central solid plate. Otherwise material which, during the tumbling action, is lifted up might pass directly from the upstream grinding compartment, through the central area of the diaphragm and swept by the scoop apparatus with the consequence that the maintenance of the pool of fluidized material in the short compartment — and thereby in the upstream grinding compartment — might be endangered.

The construction according to the invention renders it possible to fix the depth of the pool independently of the dimension of the central opening in the dam ring or an outlet opening in a hollow trunnion.

Preferably, the dam ring bounding the short compartment downstream is rigidly attached to the mill shell, whereas the sieving diaphragm — which is preferably made up of a number of sectors — and the intermediate plate, are supported from the dam ring by means of distance pieces which are configured to provide the desired spacing.

The dam ring is usually a sturdy construction heaving a wear-resistant lining which under normal working conditions does not require any regular maintenance. The sieving diaphragm may need such maintenance. Under these circumstances it is an advantage that replacement of parts of the sieving diaphragm or of the complete diaphragm is facilitated enabling such work to be carried out in the shortest possible time.

However, it may also be necessary to adjust the intermediate plate at least during the initial starting-up of the grinding mill. This may be accomplished by adjusting the passages through the intermediate plate so that the level of the pool of fluidized material in the upstream secton of the short compartment is set at a height which guarantees the best possible grinding performance and economy of each mill. For this reason an advantage of the invention resides in the capability of dismantling the sieving diaphragm and the intermediate plate in a simple, time-saving manner.

If the mill is a single-compartment mill the dam ring may be constituted by the outlet end wall of the mill and it may be arranged to discharge through a hollow trunnion.

The intermediate plate may have, in addition to the discharge opening or openings, a central passage which opens directly into a downstream grinding compartment or the outlet of the mill. By means of this central passage an abnormal overfilling of the upstream grinding compartment with ground material may be avoided in the event that — owing to the rate of feed to the mill or other conditions — the discharge arrangement of the short compartment is unable to cope with the production.

In an alternate embodiment of the invention, the intermediate plate may be further arranged with a central part formed as a shroud and protruding toward the central opening in the dam ring to act as grinding for the material to be discharged into a downstream grinding compartment or the outlet of the mill by means of the lifters in the downstream section of the short compartment. The guiding surface facilitates emptying of the section in question while forming an obstacle to prevent grinding bodies from passing into the short compartment from the downstream grinding compartment. In the event that some grinding bodies may accidentally still pass into the downstream section of the short compartment, they are immediately returned to the downstream grinding compartment by means of the lifters. Further the lifters and the guiding surface prevents such grinding bodies from directly or indirectly proceeding back into the upstream section of the short compartment.

By keeping the short compartment completely free of grinding bodies or accumulations thereof, the frequent shutdowns which would otherwise be necessitated — to remove the grinding bodies from the short compartment — are clearly avoided. Under such circumstances, such shutdowns would not otherwise be avoidable since the grinding bodies would normally give rise to excessive wear of the parts constituting the short compartment while obstructing the passage of material through the mill.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
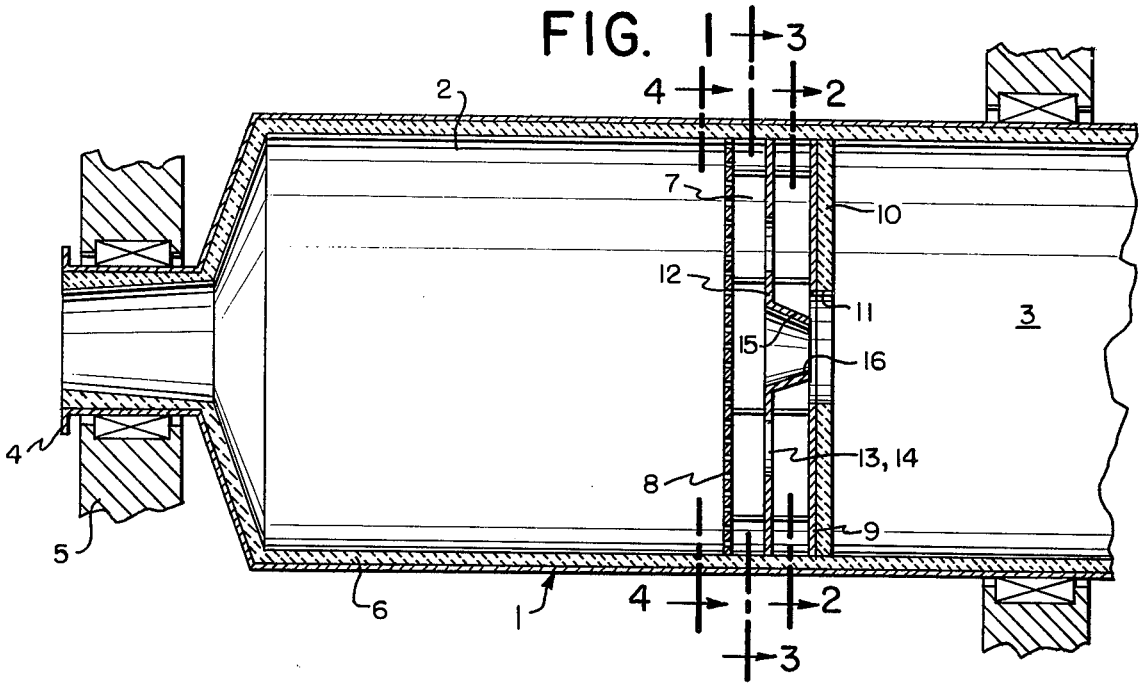
FIG. 1 is a vertical cross-sectional view of the mill of the present invention.

The illustrated mill 1 has at least two grinding compartments 2 and 3 and is equipped with hollow trunnions 4 which serve as inlet for material to be ground and as outlet for the ground material respectively. The outlet end is not shown in the drawing. The trunnions 4 are supported by stationary bearings 5.

Figure 3A:
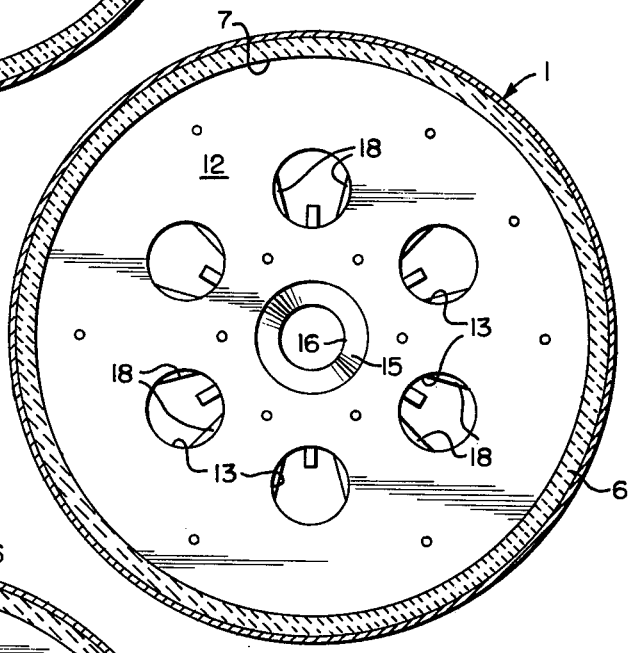
FIG. 3A is a section taken along lines 3—3 of FIG. 1.
Figure 3B:
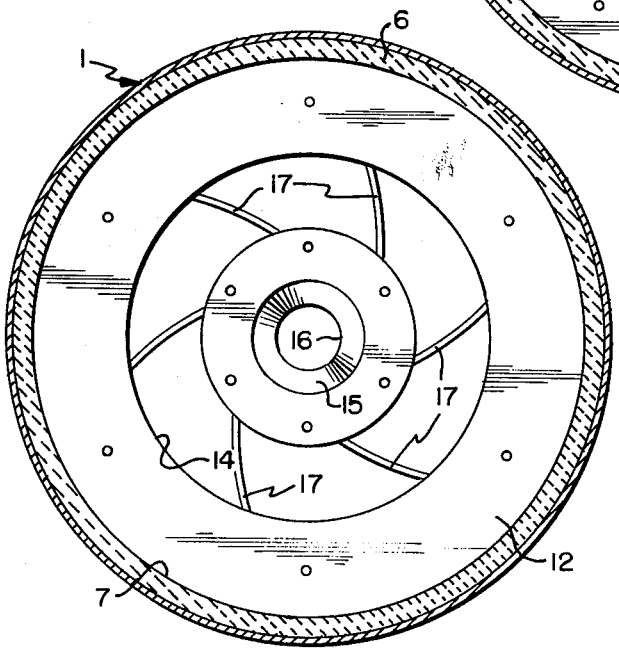
FIG. 3B is a view similar to FIG. 3A, but of an alternate embodiment of the invention.

Further, the mill 1 has a wear-resistant lining 6. The grinding compartments 2 and 3 are separated by a short compartment 7 which is formed between a sieving diaphragm 8 and a dam ring 9, likewise provided with a wear-resistant lining 10, and having a central opening 11. The short compartment has an intermediate plate 12 with a number of openings 13 for overflow of material as shown in FIG. 3A. Alternately the plate 12 may have a single ring formed opening 14 for overflow material as shown in FIG. 3B. The intermediate plate has a shroud 15 with a central discharge opening 16.

Figure 2A:
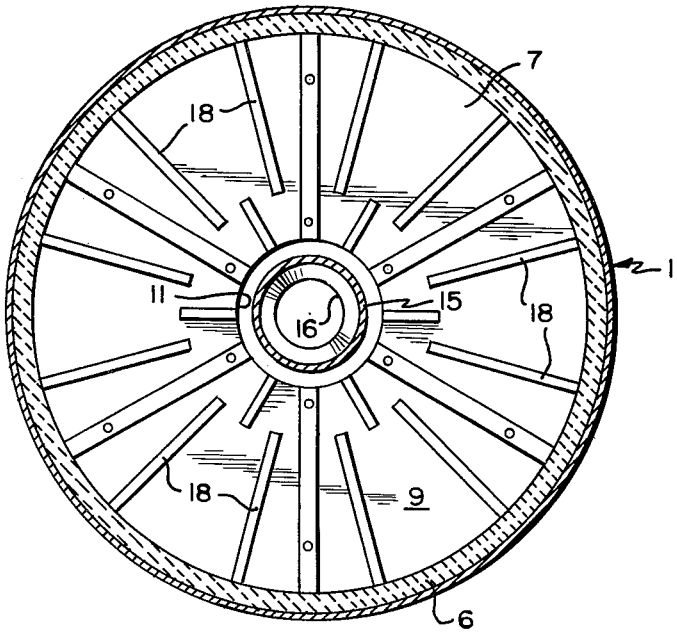
FIG. 2A is a section taken along lines 2—2 of FIG. 1.

The section of the short compartment formed between the intermediate plate 12 and the dam ring 9 has lifters as shown in FIG. 2A. The lifters may be straight lifters 18 as shown in FIG. 2A or alternately they may be curved such as the lifters 17 illustrated in FIG. 2B. The straight lifters 18 function equally well when the mill rotation is either clockwise or anticlockwise. Thus in installations in which it is necessary to reverse the rotation of the mill to reduce wear on the lining, straight lifters are preferred.

Figure 4A:
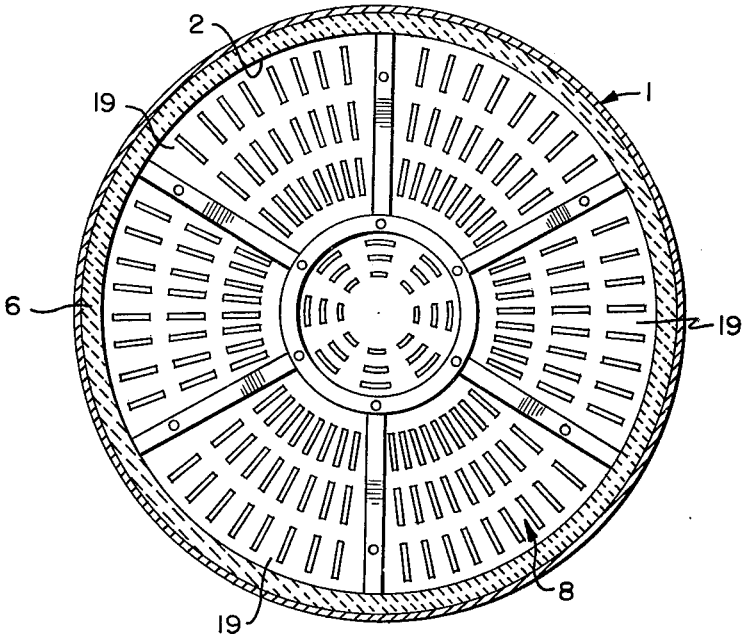
FIG. 4A is a section taken along lines 4—4 of FIG. 1.
Figure 4B:
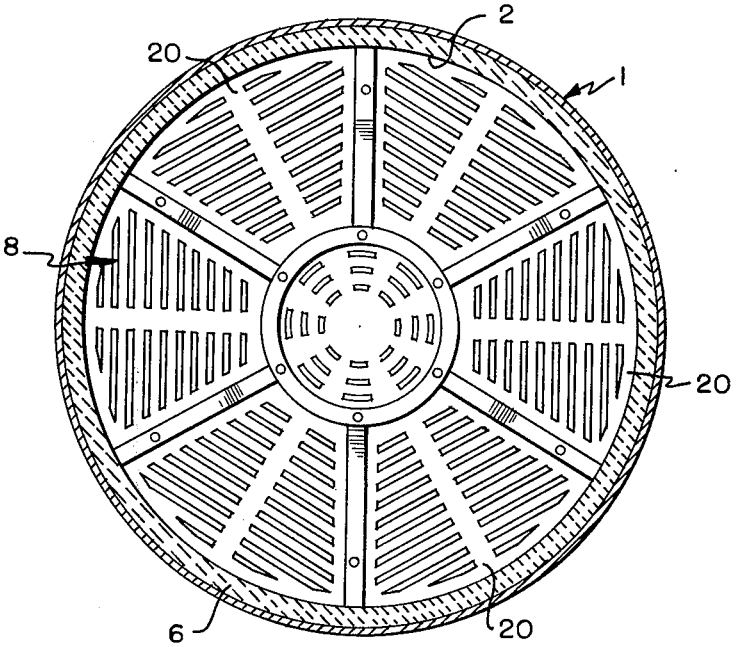
FIG. 4B is a view similar to FIG. 4A, but of an alternate embodiment of the invention.

FIG. 4A illustrates the sieving diaphragm 8 of FIG. 1. The diaphragm is composed of sections 19 having a pattern of slits as shown in FIG. 4A. Alternately it may have a pattern of slits as shown in FIG. 4B.

In operation coarse material is fed to the mill through the hollow trunnion 4 and into the grinding compartment 2 in which the coarse material is ground by means of a charge of grinding bodies. The grinding must be to such a fineness that the material may pass through the slits in the sieving diaphragm 8 into the upstream section of the short compartment 7. The ground product is fluidized by air during the violent agitation of the charge and flows like a liquid so that the material having passed the screen forms a pool having a substantially horizontal surface in the upstream section of the short compartment during rotation of the mill. The material of this pool may flow back through the diaphragm and assist in building up and maintaining a corresponding pool in the grinding compartment 2 at the toe of the charge of grinding bodies and coarse material lifted up in the grinding compartment.

Figure 2B:
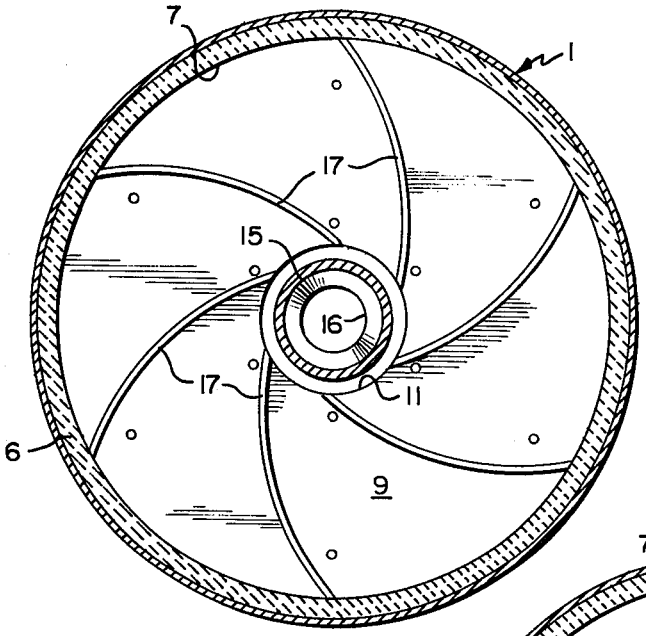
FIG. 2B is a view similar to FIG. 2A, but of an alternate embodiment of the invention.

The ground material from the pool in the upstream section of the short compartment passes by overflow through the opening 13 in FIG. 3A (or 14 in FIG. 3B) of the intermediate plate 12 into the downstream section of the short compartment from which the material is discharged through the central opening 11 of the dam ring 9 into the grinding compartment 3 by means of the lifters 18 of FIG. 2A (or 17 of FIG. 2B). This downstream section is always more or less empty, whereas the upstream section contains the pool from which material can be discharged only by overflow through the openings 13 (or 14) so that it cannot be destroyed by the lifting apparatus.

Grinding bodies which by accident have passed into the downstream section of the short compartment are automatically returned to the downstream grinding compartment by the lifters 18 of FIG. 2A (or 17 of FIG. 2B) so that an accumulation of grinding bodies in the short compartment cannot take place.

I claim:

1. A tube mill for dry grinding a granular material and the like comprising at least one grinding compartment charged with grinding bodies, a relatively short compartment positioned downstream of said grinding compartment and bounded on the downstream portion by a dam ring defining a central opening and on the upstream portion by a sieving means capable of retaining the grinding bodies in said grinding compartment, said short compartment being so configured to permit fluidized ground material to flow at least from the upstream grinding compartment to the short compartment, said short compartment having an intermediate plate defining upstream and downstream compartments therewithin, and at least one opening remote from the peripheral wall of the mill, said opening being positioned to correspond to the intended level of fluidized material in the upstream compartment of the short compartment and in the downstream grinding compartment, said upstream compartment of the short compartment being devoid of any lifters and said downstream compartment of the short compartment having lifting means, said lifting means being so configured as to assist in transporting the material from the downstream compartment of the short compartment into a downstream grinding compartment or out of the mill.

2. The tube mill according to claim 1 wherein said sieving means comprises a sieving diaphragm.

3. The tube mill according to claim 2 wherein the short compartment is bounded on the downstream side by a second grinding compartment having a charge of grinding bodies.

4. The tube mill according to claim 3 wherein said intermediate plate has a central portion in the form of a shroud protruding toward the central opening in the dam ring to serve as a guiding surface for the material to be discharged into a downstream grinding compartment or the outlet of the mill, said mill further comprising lifting devices in the downstream section of the short compartment to assist the discharge of material into a downstream grinding compartment or the outlet of the mill.

5. The tube mill according to claim 2 wherein said dam ring bounding said short compartment on the downstream portion is rigidly attached to the mill shell and said sieving diaphragm and said intermediate plate are supported from the dam ring by means of distance pieces.

6. The tube mill according to claim 5 wherein said intermediate plate further defines a central passage which opens directly into a downstream grinding compartment or the outlet of the mill.

7. The tube mill according to claim 5 wherein said intermediate plate has a central portion in the form of a shroud protruding toward the central opening in the dam ring to serve as a guiding surface for the material to be discharged into a downstream grinding compartment or the outlet of the mill, said mill further comprising lifting devices in the downstream section of the short compartment to assist the discharge of material into a downstream grinding compartment or the outlet of the mill.

8. The tube mill according to claim 5 further comprising a sole grinding compartment and the dam ring constituting the outlet end wall of the mill, said dam ring being arranged to discharge ground material through a hollow trunnion.

9. The tube mill according to claim 8 wherein said intermediate plate further defines a central passage which opens directly into the outlet of the mill.

10. The tube mill according to claim 8 wherein said intermediate plate has a central portion in the form of a shroud protruding toward the central opening in the dam ring to serve as a guiding surface for the material to be discharged into the outlet of the mill, said mill further comprising lifting devices in the downstream section of the short compartment to assist the discharge of material into the outlet of the mill.

11. The tube mill according to claim 2 further comprising a sole grinding compartment and the dam ring constituting the outlet end wall of the mill, said dam ring being arranged to discharge ground material through a hollow trunnion.

12. The tube mill according to claim 11 wherein said intermediate plate further defines a central passage which opens directly into the outlet of the mill.

13. The tube mill according to claim 11 wherein said intermediate plate has a central portion in the form of a shroud protruding toward the central opening in the dam ring to serve as a guiding surface for the material to be discharged into the outlet of the mill, said mill further comprising lifting devices in the downstream section of the short compartment to assist the discharge of material into the outlet of the mill.

14. The tube mill according to claim 2 wherein said intermediate plate further defines a central passage which opens directly into a downstream grinding compartment or the outlet of the mill.

15. The tube mill according to claim 14 wherein said intermediate plate has a central portion in the form of a shroud protruding toward the central opening in the dam ring to serve as a guiding surface for the material to be discharged into a downstream grinding compartment or the outlet of the mill, said mill further comprising lifting devices in the downstream section of the short compartment to assist the discharge of material into a downstream grinding compartment or the outlet of the mill.

16. The tube mill according to claim 2 wherein said intermediate plate has a central portion in the form of a shroud protruding toward the central opening in the dam ring to serve as a guiding surface for the material to be discharged into a downstream grinding compartment or the outlet of the mill, said mill further comprising lifting devices in the downstream section of the short compartment to assist the discharge of material into a downstream grinding compartment or the outlet of the mill.

17. The tube mill according to claim 2 wherein said sieving diaphragm defines a plurality of radial slits.

18. The tube mill according to claim 2 wherein said sieving diaphragm defines a plurality of substantially circumferentially positioned slits spaced radially from each other from the central portion of the diaphragm toward the wall of the tube mill.

* * * * *